US005781928A

United States Patent [19]

Avila

[11] Patent Number: 5,781,928

[45] Date of Patent: Jul. 21, 1998

[54] MULTI-PURPOSE HAND PROTECTOR

[76] Inventor: Louis J. Avila, 336 Roosevelt Ave., Salt Lake City, Utah 84115

[21] Appl. No.: 714,574

[22] Filed: Sep. 16, 1996

[51] Int. Cl.[6] ..... A41D 13/08

[52] U.S. Cl. ..... 2/16; 2/159; 2/170; 602/22

[58] Field of Search ..... 2/16, 170, 162, 2/163, 166, 159, 161.1, 161.4; 602/22, 21

[56] References Cited

U.S. PATENT DOCUMENTS

| | | | |
|---|---|---|---|
| 1,627,382 | 5/1927 | Golomb | 2/16 |
| 1,716,221 | 6/1929 | Fernie | 2/16 |
| 3,203,006 | 8/1965 | Shirey | 2/161.1 |
| 3,605,120 | 9/1971 | Hobbs | 2/16 |
| 3,890,649 | 6/1975 | Diggins | 2/16 |
| 4,067,063 | 1/1978 | Ettinger | 2/16 |
| 4,400,829 | 8/1983 | Willis | 2/16 |
| 4,905,321 | 3/1990 | Walunga | 2/161.1 |
| 5,058,573 | 10/1991 | Hess et al. | 602/21 |

*Primary Examiner*—Gloria M. Hale
*Attorney, Agent, or Firm*—Marcus G. Theodore

[57] ABSTRACT

A lightweight, padded, washable multi-purpose hand protector comprising a fingerless half glove for baseball players, football players, boxers and martial artists to protect the hands and knuckles.

11 Claims, 4 Drawing Sheets

MULTI-PURPOSE HAND PROTECTOR

BACKGROUND OF THE INVENTION

1. Field

This invention pertains to gloves and handwraps for boxers, fighters, and other athletes. More particularly, it relates to a padded fingerless half glove for use in football, baseball. It can also be used with a handwrap to protect the hands when struck in boxing, and the martial arts.

2. State of the Art

Various gloves and handwraps for covering the hand during martial arts fights and exhibitions are known. There are a number of handwraps to protect the hands of martial arts fighters and boxers. There are also a numbers of knuckle guards to prevent sore knuckles resulting from repeated hand blows as shown on pages 16 and 17 of the latest 1996 Ringside™ catalogue.

Lewis, U.S. Pat. No. 2,567,489 discloses a hand bandage which is a combination fingerless glove secured about the hand via a separate handwrap for boxers and fighters. Because of the two piece construction, this hand protector is difficult to secure about the hands without the assistance of another.

Andujar, U.S. Pat. No. 5,083,314 discloses a unitary molded martial arts sports glove covering the entire hand which has an elastic strap with hook and loop strips thereon to secure the sports glove to the hand. It has a padded glove with a protective pad covering the back of the hand and thumb for protection when a blow is struck. Arthur, U.S. Pat. No. 4,361,912 discloses a padded karate glove, boot, and shinguard which do not include the use of wrist straps. Rhee, U.S. Pat. No. 3,093,546 discloses another padded karate glove which does not include the use of wrist straps. These sports and karate gloves are not adapted for use with conventional boxing gloves, and therefore are not insertable therein.

Fabry, U.S. Pat. No. 5,517,694 discloses a fingerless glove with a handwrap which is primarily designed for use by weightlifters. Walunga, U.S. Pat. No. 4,905,321 discloses another workout glove with detachable wrist strap to provide protection from injury to the wrist tendons and strengthen the wrists for lifting of heavy weights.

In addition, there are a number of sliding and batting gloves to protect the hands during baseball play. Other padded gloves are used during football play.

None of the foregoing provides a lightweight, padded, washable multi-purpose fingerless half glove which can be combined with an elastic handwrap for boxers and fighters to protect the hands and prevent sore knuckles resulting from repeated hand contact or blows. The device described below provides such an invention.

SUMMARY OF THE INVENTION

The invention is a lightweight, padded, washable multi-purpose fingerless half glove which can be combined with an elastic handwrap for boxers and fighters to protect the hands and prevent sore knuckles resulting from repeated hand contact or blows. The simplest embodiment of the multi-purpose hand protector comprises a fingerless half glove having a top knuckle portion joined with a finger segment to a bottom palm portion. The fingerless half glove has finger openings in the finger segment into which digits of a hand may be inserted. The top of the fingerless half glove extends to cover the top of the knuckles and is padded to protect the knuckles, when struck. This knuckle portion forms a band covering the top of the knuckles extending proximate the point of attachment of the thumb. Thus, the thumb is left free, as are the digits of the hand. The width of the palm portion is of a lesser width than the knuckle portion, providing a lightly padded palm segment beneath the knuckles which allows the clenching of the fist to protect the fingers during hand contact. This padded palm covering the undersegment of the palm beneath a user's knuckles also protects the underside of the palm from injury when hit while the hand is open.

The above fingerless half glove embodiment is particularly adapted for use in baseball as a sliding glove wherein the fists are clenched during sliding to protect the hand from ground contact, or if stepped on. Because the fingers and thumb are free, the fingerless half glove embodiment may be used for batting. The thumb and fingers are free to provide complete bat control, but the padded palm prevents the stinging of palm in the event of a mishit. It may also be worn under a fielders or catcher's glove to provide additional padding to protect the underside of the palm when a ball is caught.

This fingerless half glove is also particularly suited for use by football linemen who need to protect both the front and back of their knuckles during open and closed hand contact. It also leaves them free to use their fingers and thumb to handle or intercept the football.

This preferred multi-purpose hand protector is constructed of cotton padding approximately ¼ to ½ inches thick, which can be readily cleaned and washed. The half glove runs the width of the hand. It is preferably constructed of a singled piece of folded cotton padding with the knuckle portion approximately 3½ inches wide, and the palm portion approximately 2 inches wide. At the fold are four digit holes in the finger segment into which the fingers of the hand are inserted. Thus constructed, the half glove provides a lightly padded palm which allows the hand to clench into a fist. This padded palm reduces injury to the fingers during fist contact, while covering the exterior of the knuckles with padding to protect the knuckles to minimize their injury during fist contact.

For use in boxing, the multi-purpose half glove hand protector generally includes an elastic wrist wrap attached thereto to hold and protect the hand bones. The elastic wrist wrap has a first end permanently, or removably, attached to the fingerless half glove to aid a fighter in wrapping his hand without assistance, and to prevent loosening or unraveling during the fight. The second end of the elastic wrist wrap has hook and loop strips to removably secure the wrist wrap about the fingerless half glove. This wrist wrap is of a length sufficient to wrap about the hand and fingerless glove as well as between a user's fingers for added hand protection. The first end of the elastic wrist wrap is preferably attached to the side of the fingerless half glove opposite the thumb. The second end of the elastic wrap has corresponding hook and loop strips to removably secure the wrist wrap about the fingerless glove, when wrapped. The wrist wrap is of a length sufficient to wrap about the fingerless glove and between a user's fingers sufficiently for hand protection—i.e. approximately 180 inches for larger hands, and approximately 120 inches for smaller hands. The hook and loop closure system enables a user to wrap and secure the handwraps about the fingerless full glove without assistance.

For use in martial arts where the back of the hand is used to strike an opponent, the fingerless half glove is extended into a full glove to cover the entire hand and wrist. In this full glove embodiment, the multi-purpose sports hand protector comprises a fingerless glove having a hand portion, and a wrist portion. The wrist portion has an entry hole for the wrist. The hand portion has thumb and finger openings into which digits and the thumb of a user are removably inserted. The hand portion has a lightly padded top and bottom segment covering the top and bottom of a user's hand. This padding must not be too thick to prevent closure of the hand. If added padding is desired along the top of the knuckles, the back of the fingerless glove may include a high impact closed cell foam pad, or be constructed entirely of high impact closed cell foam.

Attached to the fingerless full glove is a similar elastic wrist wrap described above. When secured about the hands, the wrist wrap provides additional padding as well as securely holds the bones of the hand in position to minimize injuries during contact.

In one preferred embodiment, the fingerless full glove is also constructed of cotton with padding approximately ¼ to ½ inches thick. This cotton glove is washable after use, and is not too bulky to prevent the insertion of the wrapped hand and glove into a conventional boxing glove. Preferably, the attached elastic wrist wrap is constructed of a slightly elastic herringbone weave cotton, although any slightly elastic washable material may be used.

This improved combination fingerless full glove and wrist wrap also provides a reusable, washable handwrap with hook and loop closure means can be used without assistance from another person. It also allows the wrapping of the hand and between the fingers for added hand protection, as well as acting as knuckle guards to prevent hand injuries.

Thus, the above invention provides a readily adaptable multipurpose sports hand protector which can be repeatedly washed and re-used.

DESCRIPTION OF THE ILLUSTRATED EMBODIMENTS

Figure 1:
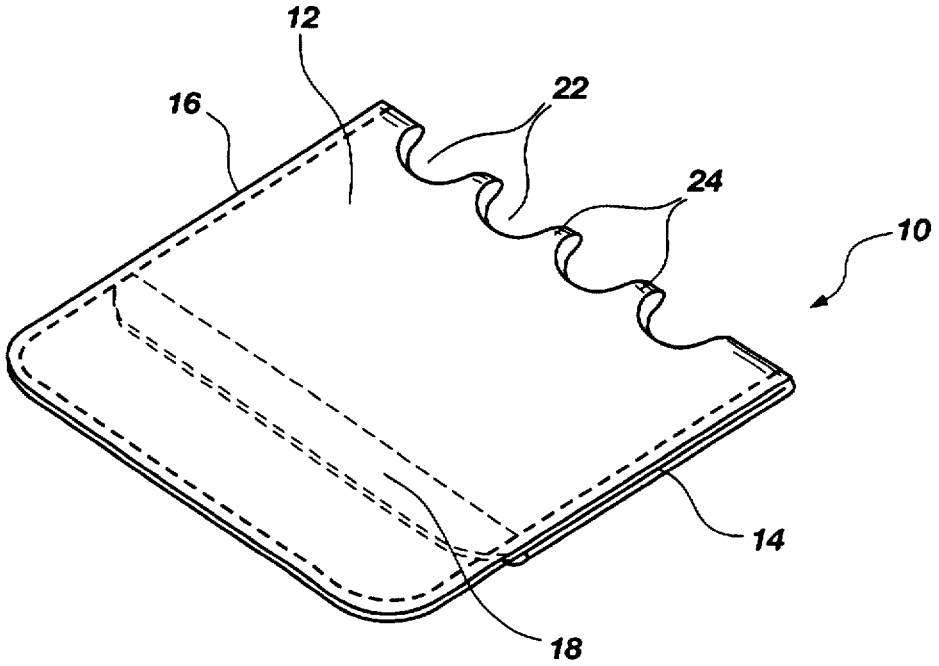
FIG. 1 is a perspective view of a preferred embodiment of the invention.

A preferred embodiment of the present invention shown in FIG. 1 comprises a multi-purpose hand protector half glove 10. The half glove 10 runs the width of the hand. It is constructed of a singled piece of folded cotton padding approximately ¼ to ½ inches thick at the knuckle segment 12 covering the top of the knuckles, and the the palm segment 14 covering the underside of the knuckle bones on the bottom of the palm. The sides 16 of the half glove 10 are stitched together, leaving an opening 18 into which the fingers of the hand are inserted. On a large size hand, the knuckle segment 12 is approximately 3½ inches wide, and the palm segment 14 is approximately 2 inches wide. At the unpadded finger fold 20 are four digit holes 22 into which the fingers of the hand are inserted. The lightly padded palm segment 14 allows the hand to clench into a fist, while the unpadded fold 20 allows the fingers to open and spread or be selectively taped together, if desired. The padded palm segment 14 prevents injury to the fingers and hand bones during fist contact. The padded knuckle segment 12 covering of the exterior of the knuckles also prevents their injury during contact.

Figure 2:
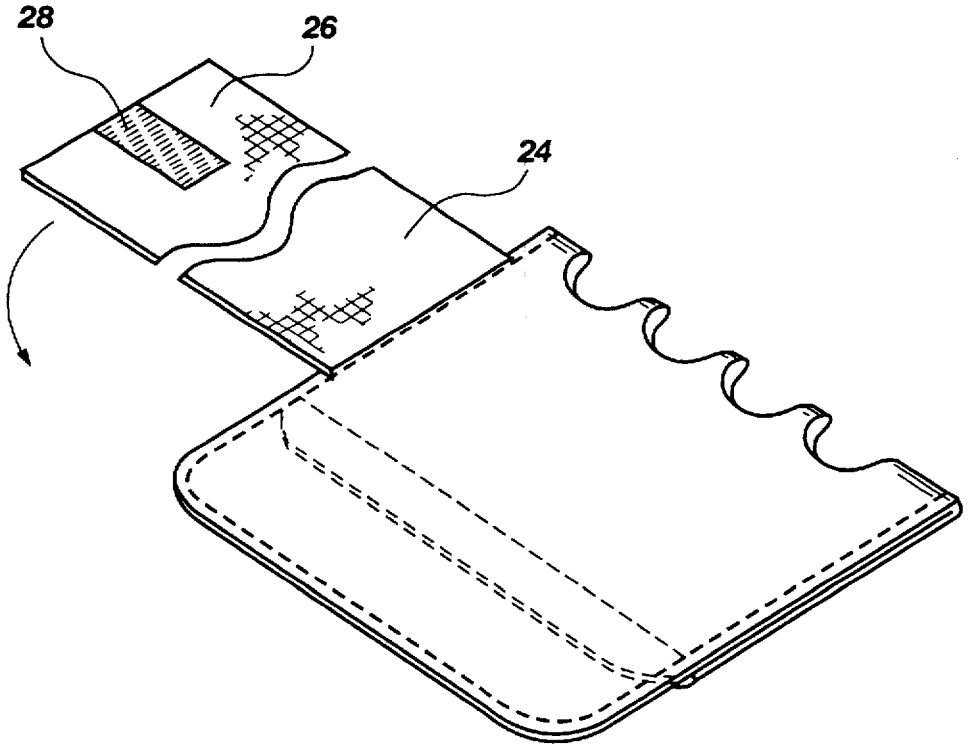
FIG. 2 is a perspective view of the preferred embodiment of the invention shown in FIG. 1 with a handwrap attached.

FIG. 2 illustrates a combination half glove 10 with a slightly elastic washable handwrap 24 approximately 180 inches long by 2 inches wide stitched to the side 16 of the half glove 10. Strong herringbone weave cotton is preferably used for the handwrap 24. This handwrap 24 has another end 26 with a hook and loop fastening system 28 to secure the handwrap 24 in position about the hand and wrist of a user, when wrapped. The combination fingerless half glove 10 and handwrap 24 better secures the handwrap 24 in position to properly start and secure the handwrap 24 about a fighters hands and wrists. It thus will not loosen and shift during use, and provides a padded knuckle guard, while allowing the wrapped and glove hands to fit into conventional boxing gloves.

Figure 3:
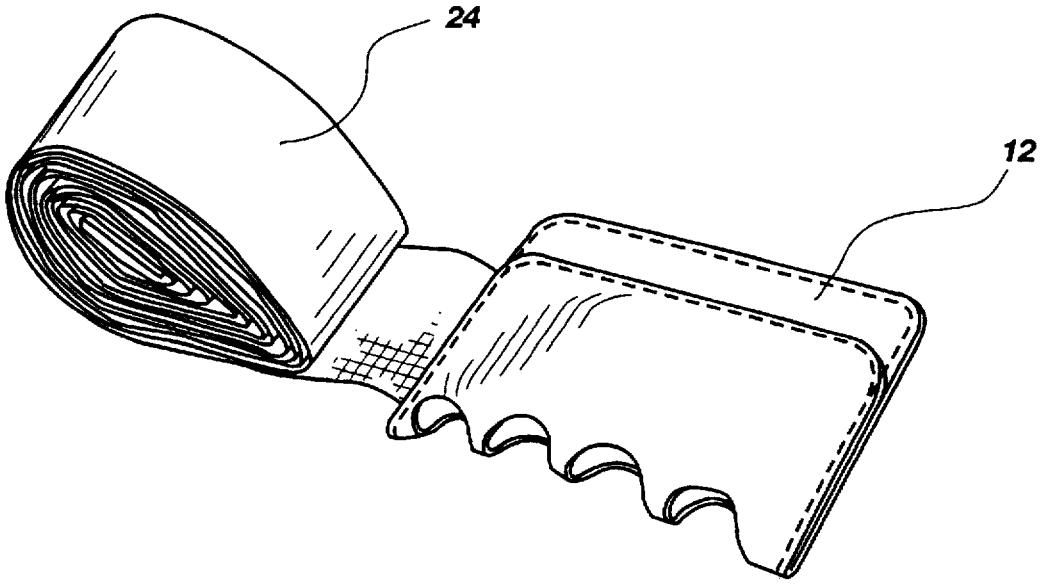
FIG. 3 is a perspective view of the combination half glove and handwrap shown in FIG. 2.
Figure 4:
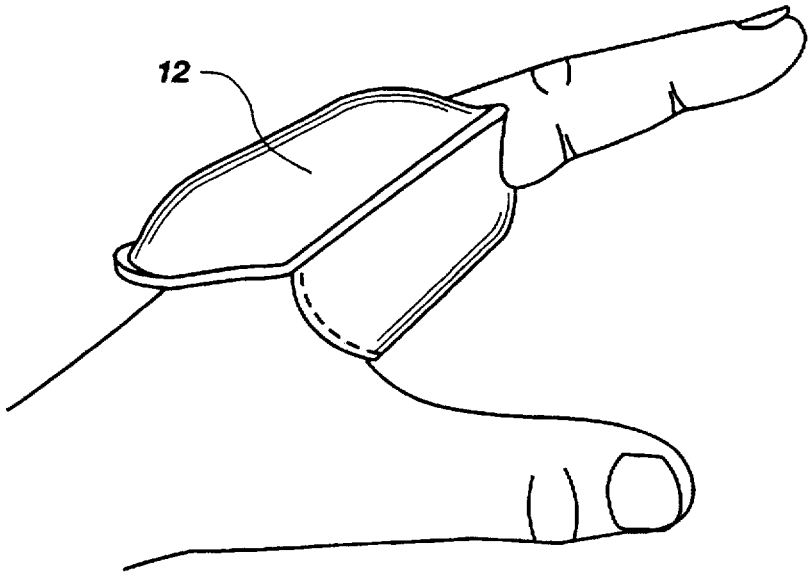
FIG. 4 is another perspective view of the combination half glove and handwrap shown in FIG. 2 with a hand inserted therein.
Figure 5:
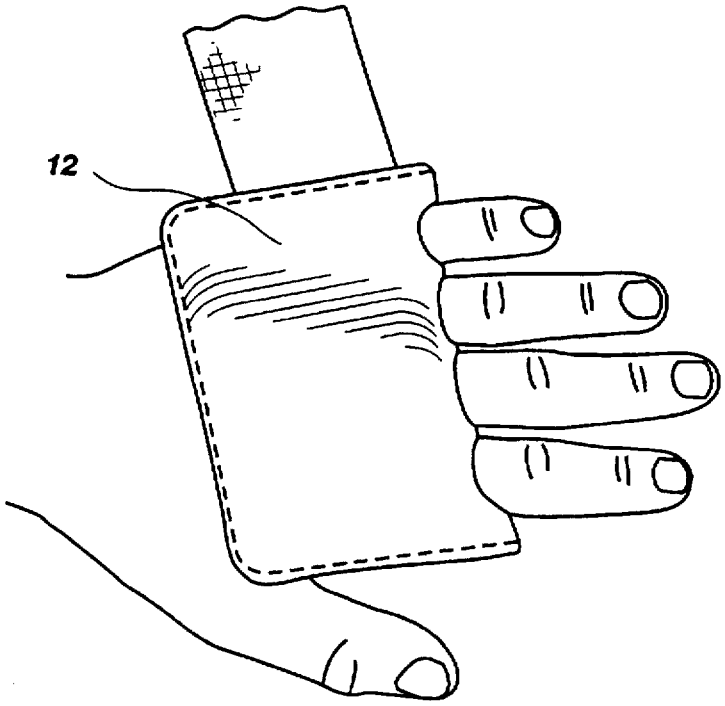
FIG. 5 is a top view of the combination half glove and handwrap shown in FIG. 2 with a hand inserted therein.
Figure 6:
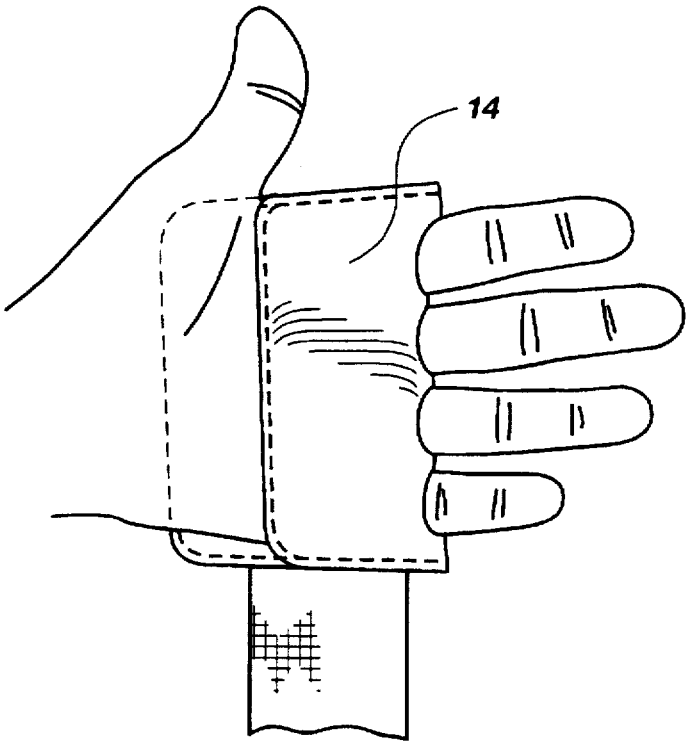
FIG. 6 is a bottom view of the combination half glove and handwrap shown in FIG. 2 with a hand inserted therein.

FIG. 3 is a perspective view of the combination half glove 10 and handwrap 24 shown in FIG. 2. FIG. 4 is another perspective view of the combination half glove 10 and handwrap 24 shown in FIG. 2 with a hand inserted therein. FIG. 5 is a top view of the combination half glove 10 and handwrap 24 shown in FIG. 2 with a hand inserted therein. FIG. 6 is a bottom view of the combination half glove 10 and handwrap 24 shown in FIG. 2 with a hand inserted therein.

Figure 7:
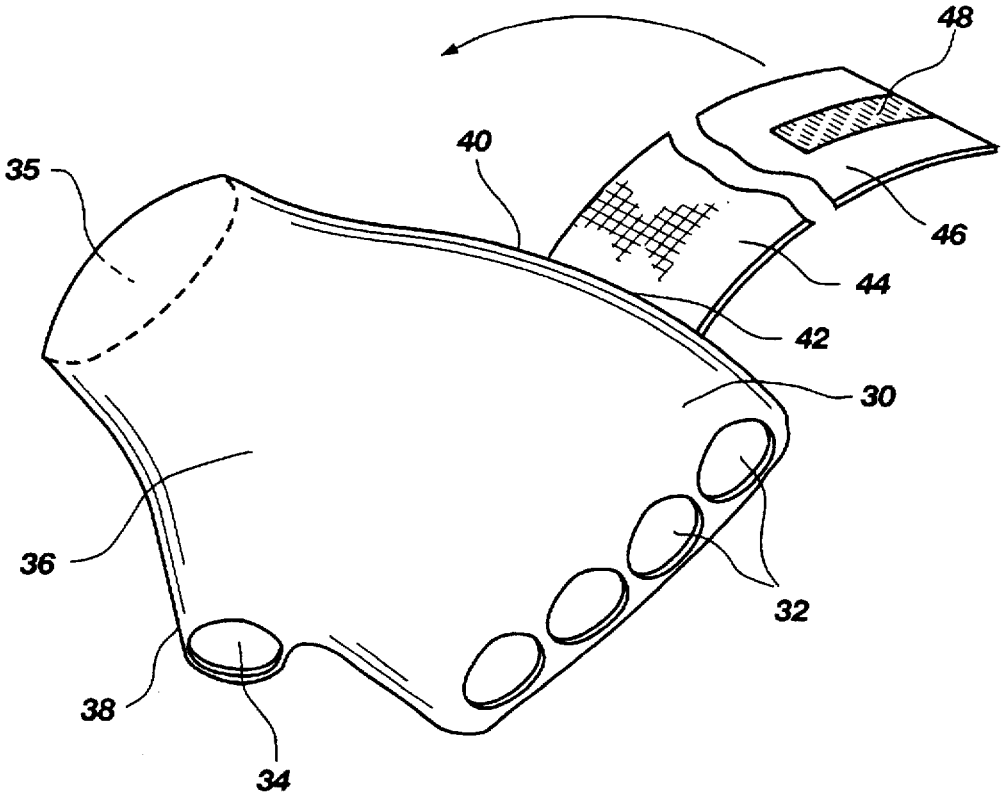
FIG. 7 is a perspective view of another preferred embodiment of the invention.

FIG. 7 illustrates another preferred embodiment of the present invention employing a full glove 30 covering the entire hand for use in martial arts. It comprises a combination knuckle guard fingerless glove 30 with fingerholes 32, a thumbhole 34, and a wristhole 35. The glove 30 is made of washable cotton with atop 36 and bottom 38 padding covering both the back and the palm of the hand with an approximately ¼ to ½ inch thick cotton pad. Attached to the side 40 of the glove 30 is one end 42 of a slightly elastic washable handwrap 44 approximately 180 inches long by 2 inches wide. Strong herringbone weave cotton is preferably used for the handwrap 44. This handwrap 24 has another end 46 with a hook and loop fastening system 48 to secure the handwrap 44 in position about the hand and wrist of a user, when wrapped. The combination knuckle guard fingerless glove 30 and handwrap 44 better secures the handwrap 24 in position to properly start and secure the handwrap about a fighters hands and wrists. It also will not loosen and shift during use, and provides a padded knuckle guard, while allowing the wrapped and glove hands to fit into conventional boxing gloves.

Figure 8:
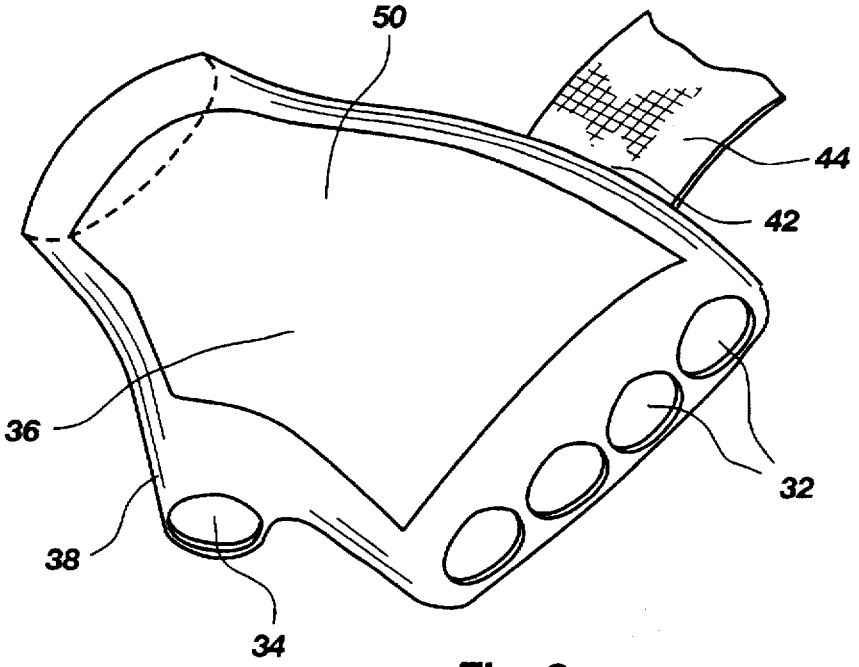
FIG. 8 is a perspective view of the preferred embodiment of the invention shown in FIG. 2 with a handwrap attached.

FIG. 8 illustrates another preferred embodiment of the glove 30 employing a high impact closed cell foam pad 50 covering the top 16 of the glove 10 of covering the back of the hand. It is used where additional padding is required to protect the knuckles.

Although the specification refers to the illustrated embodiments, it is not intended to restrict the scope of the appended claims. The claims themselves recite those features deemed essential to the invention.

I claim:

1. A multi-purpose hand protector comprising:

a fingerless half glove having a knuckle portion, a palm portion, and a finger portion defining finger openings for insertion of digits of a hand said knuckle portion having a padded top to cover the top of the knuckles and protect the knuckles, when stuck, and a padded palm portion to cover the segment of the palm beneath a user's knuckles to allow the fingers to clench into a fist to protect the fingers during hand contact.

2. A multi-purpose hand protector according to claim 1, wherein the fingerless half glove is constructed of cotton padding approximately ¼ to ½ inches thick.

3. A multi-purpose sports hand protector according to claim 1, including an elastic wrist wrap having a first end attached to the fingerless half glove, and a second end with hook and loop strips to removably secure the wrist wrap about the fingerless half glove; said wrist wrap of a length and width sufficient to wrap about the fingerless glove and hand and between a user's fingers sufficiently for hand protection.

4. A multi-purpose hand protector according to claim 3, wherein the elastic wrist wrap is removably attachable to the fingerless half glove.

5. A multi-purpose hand protector according to claim 3 wherein the fingerless half glove extends to cover the wrist with a wrist portion, and a hand portion, the wrist portion defining an entry hole for insertion of the wrist, and the hand portion defining thumb and finger openings into which digits and a thumb are inserted; said hand portion having and top and bottom padded to cover the top and bottom of a user's hand.

6. A multi-purpose hand protector according to claim 5, wherein the elastic wrist wrap is constructed of a slightly stretchable cotton cloth.

7. A multi-purpose hand protector according to claim 6, wherein the elastic wrist wrap is attached proximate the edge of the glove opposite the thumb opening.

8. A multi-purpose hand protector according to claim 7, wherein the fingerless glove and elastic wrist wrap are constructed of a washable material.

9. A multi-purpose hand protector according to claim 8, wherein the top of the fingerless glove is covered with a high impact closed cell foam pad.

10. A multi-purpose hand protector comprising:

a washable cotton fingerless glove having a wrist portion, and a hand portion, the wrist portion defining an entry hole for the wrist, and the hand portion defining thumb and finger openings into which digits and a thumb are inserted; said hand portion having a top and bottom padded with ¼ to ½ inch cotton padding to cover the top and bottom of a user's hand, and a washable elastic wrist wrap having a first end stitched to the fingerless glove opposite a user's thumb, and a second end with hook and loop strips to removably secure the wrist wrap about the fingerless glove; said wrist wrap of a length sufficient to wrap about the fingerless glove and between a user's fingers sufficiently for hand protection.

11. A multi-purpose hand protector for use in martial arts and hand contact sports comprising:

a washable cotton fingerless half glove having a knuckle portion, a palm portion, and a finger portion defining finger openings for insertion of digits of a hand, said knuckle portion having a padded top to cover the top of the knuckles and protect the knuckles, when struck, and a padded palm bottom portion to cover the segment of the palm beneath a user's knuckles to allow the fingers to clench into a fist to protect the fingers during hand contact, said top and bottom padded with ¼ to ½ inch padding; and a washable elastic wrist wrap having a first end attached to the fingerless glove opposite a user's thumb, and a second end with hook and loop strips to removably secure the wrist wrap about the fingerless glove; said wrist wrap of a length and width sufficient to wrap about the fingerless glove and between a user's fingers sufficiently for hand protection.

* * * * *